US005501342A

United States Patent [19]

Geibel

[11] Patent Number: 5,501,342

[45] Date of Patent: Mar. 26, 1996

[54] MAGNETIC SOCKET TRACK

[76] Inventor: Ronald J. Geibel, 1521 Sandburg Dr., Schaumburg, Ill. 60173

[21] Appl. No.: 494,727

[22] Filed: Jun. 26, 1995

[51] Int. Cl.[6] ..... B65D 85/20

[52] U.S. Cl. ..... 206/378; 206/350; 211/70.6; 248/206.5

[58] Field of Search ..... 206/350, 378, 206/493; 211/70.6; 248/205.3, 206.5; 335/285

[56] References Cited

U.S. PATENT DOCUMENTS

| | | | |
|---|---|---|---|
| 3,111,736 | 11/1963 | Budreck | 335/285 |
| 4,826,021 | 5/1989 | Burrell | 211/70.6 |
| 5,343,181 | 8/1994 | Negus | 206/350 |
| 5,398,823 | 3/1995 | Anders | 206/378 |

*Primary Examiner*—Paul T. Sewell
*Assistant Examiner*—Luan K. Bui

[57] ABSTRACT

A magnetic socket track is provided which includes a non-ferrous base with concave grips the length of the outer sides. Two sections of ferrous metal with ninety (90) degree bends lie inside the channel with the protrusion of the ninety (90) degree bends facing each other. Set between the ferrous metal strips lies a length of conventional magnetic material with the north pole facing one metal strip and the south pole facing the other, yet set far enough from the ninety (90) degree bends to provide a channel. Due to the relationship of the magnetic material and the ferrous metal, a strong magnetic field is formed at the ninety (90) degree bends and right angle material. Into this channel slide the square or hexagonal heads of the threaded non-ferrous studs, with the heads of the studs large enough to prevent the studs from rotating in the channel. Numerous studs are positioned in the channel with various sizes of non-ferrous, round, internally-threaded receptacles tightened down on the studs. The receptacles receive sockets with corresponding drive sizes. The sockets are placed over the receptacles and are held in place by magnetic energy. The round receptacles keep the sockets from being jarred off the track and also holds their precise location for return to the magnetic track after use.

4 Claims, 2 Drawing Sheets

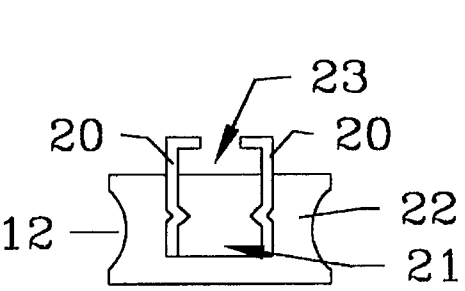
FIG.2
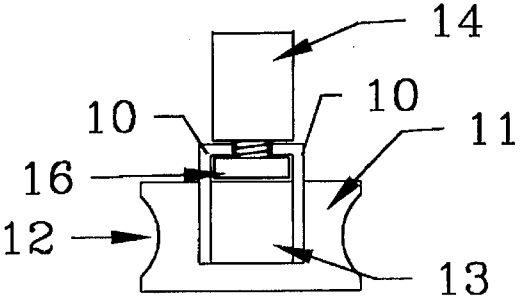
FIG.3
FIG.4
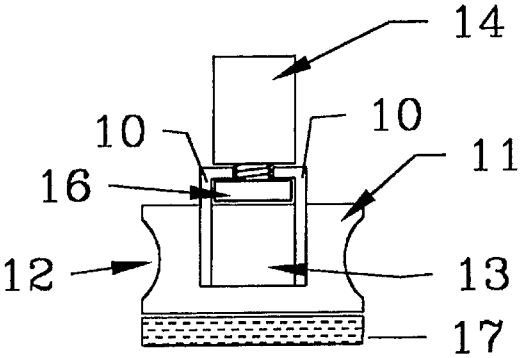
FIG.5
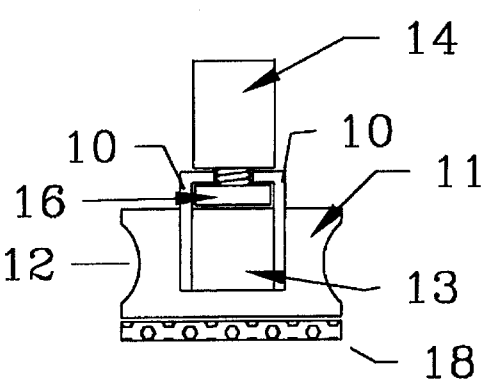
FIG.6
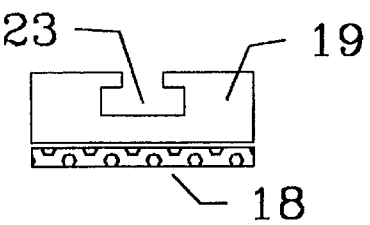
FIG.7

MAGNETIC SOCKET TRACK

FIELD OF INVENTION

This invention relates generally to socket storage, but particularly to maximizing the user's selection of square drive tools of various types and drive sizes that can be stored in a confined space (such as a tool tray or tool box drawer). The magnetic socket track can be customized by the user to meet a variety of needs. Tools placed on the receptacles can contact each other in order to utilize space, while at the same time retaining the capability to be both easily removed and returned to a preassigned location without any receptacle movement. Also, the user has the option of repositioning the receptacles as future needs may require, thereby allowing the user to customize the socket track to his or her unique needs. Additionally, the size or the individual receptacles can be changed to accept various tool drive sizes.

SUMMARY OF INVENTION

According to tile present invention, a magnetic socket track is provided. The magnetic socket track includes a non-ferrous base, concave on each side for a finger grip. Two pieces of ferrous metal, extending the length of the track, having a ninety (90) degree bend at the top with the protrusions facing each other. Sandwiched between the ferrous metal strips is a conventional magnet. The magnet's north pole contacts one metal strip, while its south pole contacts tile other. Due to the relationship of tile materials, a strong magnetic field is formed at the right angles of the bends in the metal strips. The conventional magnet is positioned at such a distance from the ninety (90) degree bends as to provide a channel. Into this channel slides the square heads of several threaded, non-ferrous studs with heads large enough to prevent them from rotating in the channel. Onto these studs are threaded various sizes of round non-ferrous receptacles. The studs can be positioned at desired locations on the track and secured at the desired locations by threading the receptacles down tight on the studs.

DESCRIPTION OF THE DRAWINGS

FIG. 2 is a tool receptacle and stud.

FIG. 3 is an end view of a magnetic socket track with receptacle and stud in view.

FIG. 4 is an end view of a magnetic socket track with all parts grooved in order to improve strength and facilitate assembly.

FIG. 5 is an end view of a magnetic socket track with a magnetic base.

FIG. 6 is an end view of a magnetic socket track, with a pressure-sensitive, double-face tape base.

FIG. 7 is a non-magnetic socket track for a fixed location with a pressure-sensitive, double-face tape base.

DETAILED DESCRIPTION OF THE PREFERRED EMBODIMENT

Figure 1:
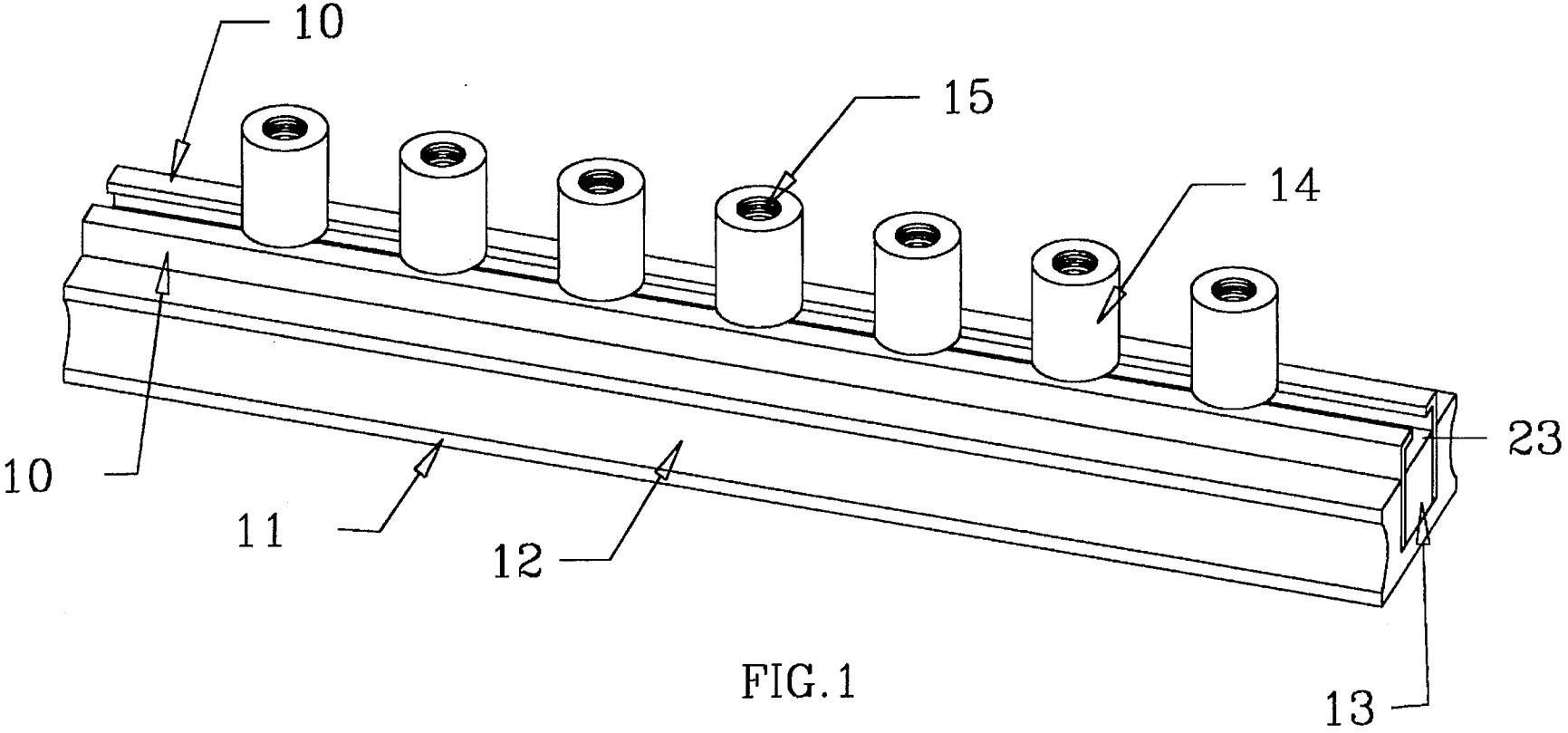
FIG. 1 is a three dimemsional view of a magnetic socket track with one size of tool receptacles installed.

Referring now to the drawing and for the present to FIGS. 1, 2, 3, 5 and 6, one embodiment of the magnetic storage track is shown. The base 11 which is non-ferrous material has finger grips 12 the full length of its sides. Two ferrous strips of metal with ninety (90) degree bends 10 sit in the base 11 facing each other. Between the two metal strips 10 is a length of conventional magnetic material 13 with the north pole facing one metal strip 10 and the south pole facing the other metal strip 10. A space is left between the magnetic material 13 and the ninety (90) degree bends in the metal strips 10 to make a channel 23. Non-ferrous threaded studs 16 with square or hexagonal heads to keep them from rotating, slide into the channel 23. With the studs 16 positioned in the desired location, internally threaded 15 non-ferrous socket receptacles 14 of the appropriate size are threaded onto the studs 16 and tightened into place. All thread sizes 15 in the receptacles 14 are the same, but the outside diameter and height vary according to the tool drive size which will fit over the receptacle 14.

The arrangement of the ferrous metal strips 10 and the magnetic material 13 creates a strong magnetic force at the surface of the metal strips 10 where the socket bases will contact it. FIG. 4 embodiment shows end views similar to FIG. 3, except the FIG. 4 base 22 ferrous metal strips 20 and magnetic material 21 are grooved through their length to improve strength and facilitate assembly. FIG. 5 embodiment is fitted with a magnetic base 17. FIG. 6 embodiment is fitted with press-sensitive double-faced tape 18 for securing. FIG. 7 embodiment is a non-magnetic base 19 with a channel 23 which accepts stud 16 and receptacle 14 with pressure-sensitive, double-faced tape 18 for use in a shallow, fixed location.

While several embodiments of this invention have been shown and described, various adaptations and modifications can be made without departing from the scope of the invention as defined in the appended claims.

Having thus described the preferred embodiment, the invention is now claimed to be:

1. A magnetic socket track comprising an elongated non-ferrous base with a channel through its length, two ferrous metal strips extending the length of the outside walls of the channel, said ferrous metal strips each having a ninety degree bend with the protrusions of the bends facing each other, a magnetic strip within the channel between the ferrous metal strips at the base of the channel, the magnetic strip having the north pole contacting one metal strip and the south pole contacting the other, the length of the ferrous metal strips being such as to provide a small channel between the magnetic material and the protrusions of the ninety degree bends in the ferrous metal strips, non-ferrous threaded studs and socket receptacles, the small channel being sized to receive the square or hexagonal heads of said non-ferrous threaded studs on which said non-ferrous socket receptacles are threaded, whereby said magnetic strip and said ferrous metal strips produce a strong magnetic force on the outside faces of the ninety degree metal protrusions and this magnetic force holds the sockets firmly on the track when they are placed over the socket receptacles.

2. The device as defined in claim 1 further characterized by the base having concave finger grips extending the length of the sides.

3. The device as defined in claim 1 wherein the base, metal strips, and magnetic material are grooved or ridged throughout their length to improve strength and facilitate assembly.

4. The device as defined in claim 1 fitted with optional means of attachment to a surface selected from the group consisting of pressure-sensitive, double-faced tape on the base, or magnetic material adhered to the base.

* * * * *